US006676046B2

(12) United States Patent
Brooks et al.

(10) Patent No.: US 6,676,046 B2
(45) Date of Patent: Jan. 13, 2004

(54) CLOSURE MEMBER WITH ARMATURE STRAP

(75) Inventors: Harry Ronald Brooks, Newport News, VA (US); Ross William Wood, Yorktown, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/922,163

(22) Filed: Aug. 6, 2001

(65) Prior Publication Data

US 2003/0025007 A1 Feb. 6, 2003

(51) Int. Cl.[7] ..... F02M 51/00

(52) U.S. Cl. ..... 239/585.5; 239/585.4; 239/900

(58) Field of Search ..... 239/585.1, 585.2, 239/585.4, 585.5, 900

(56) References Cited

U.S. PATENT DOCUMENTS 4,342,427 A 8/1982 Gary ..... 239/585
4,483,485 A 11/1984 Kamiya et al. ..... 239/585
4,915,350 A 4/1990 Babitzka et al. ..... 251/129.15
4,984,744 A 1/1991 Babitzka et al. ..... 239/585
5,875,975 A * 3/1999 Reiter et al. ..... 239/585.1
5,975,436 A 11/1999 Reiter et al. ..... 239/585.1
6,371,383 B1 * 4/2002 Bulgatz ..... 239/1

* cited by examiner

*Primary Examiner*—Christopher Kim

(57) ABSTRACT

A fuel injector having a housing including an inlet, an outlet, and a passageway for fuel flow from the inlet to the outlet. A coil assembly is disposed proximate the inlet of the fuel injector. A seat is disposed proximate the outlet of the fuel injector. A closure member is disposed in the housing and operable by the coil assembly to permit and prohibit fuel flow through the seat. The closure member includes a strap member that extends along a longitudinal axis and has at least two radial projections and a central member. The strap member includes an outer surface a distance D from the longitudinal axis. The at least two radial projections having first and second ends. A sealing member is coupled to the central member. An armature member is coupled to the second ends of the strap member. Also, a method for forming the strap member.

16 Claims, 2 Drawing Sheets

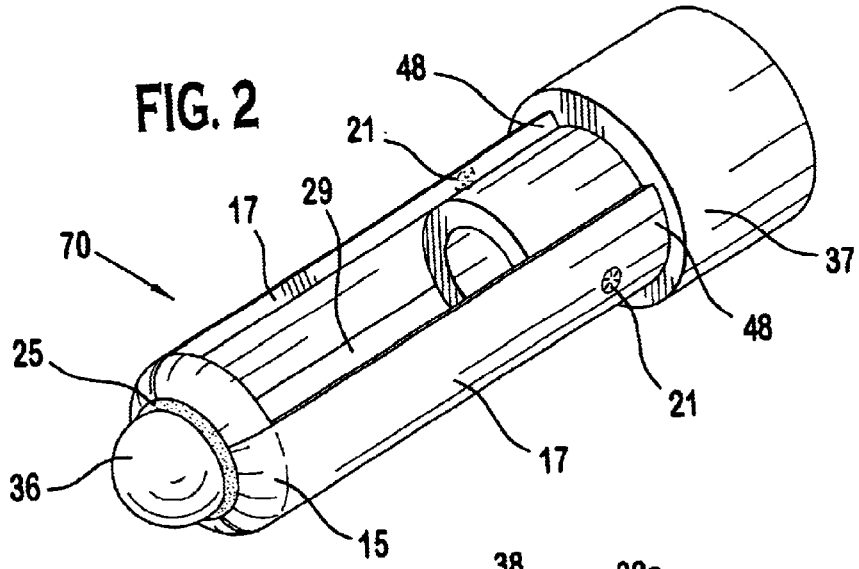
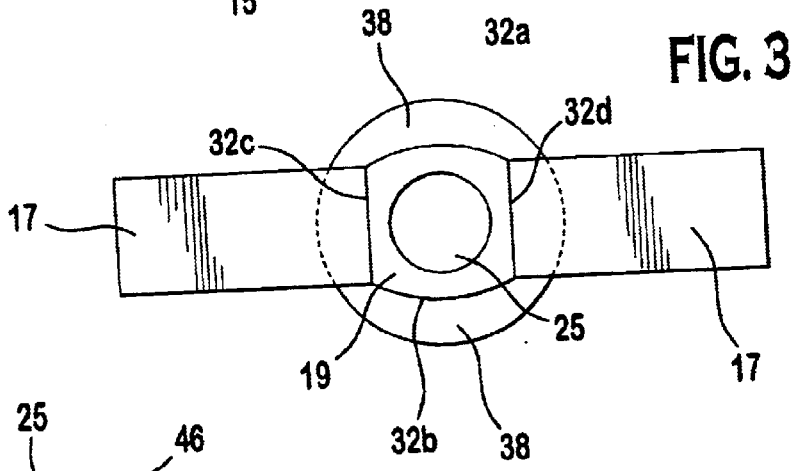
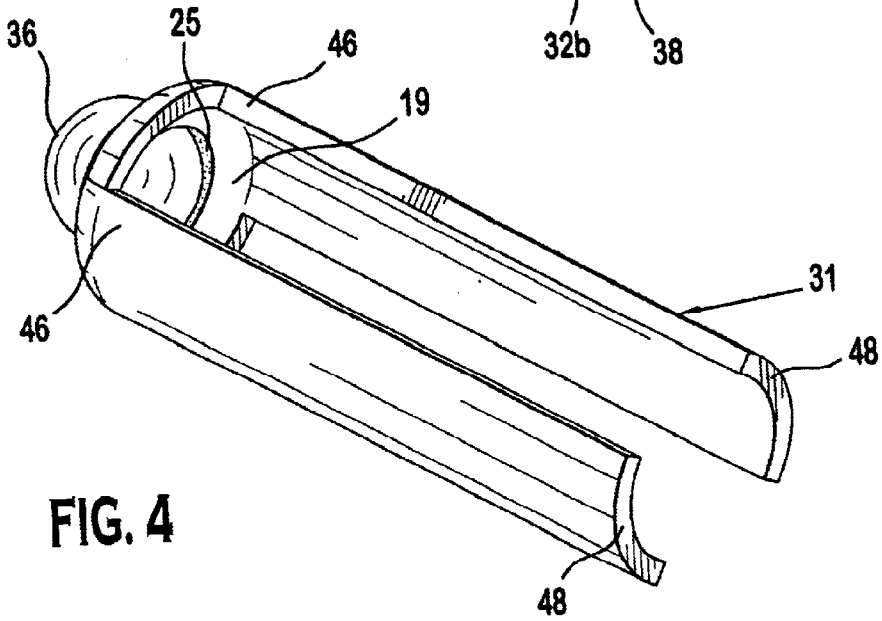
FIG. 4

CLOSURE MEMBER WITH ARMATURE STRAP

FIELD OF INVENTION

The invention relates to a closure member for a fuel injector, and more particularly to a closure member construction that may be varied to provide length compensation.

BACKGROUND OF THE INVENTION

It is known to use a variety of closure mechanisms to permit and inhibit fuel flow through fuel injectors. These mechanisms include needle and armature, ball and armature combinations. It is believed that the method of fabrication to create such components should be low cost, repeatable and accurate. It is believed to be known that previous designs of closure mechanisms either used the armature itself as the length compensator, the needle as the length compensator and or incorporated a more expensive manufacturing method for the compensator component. These designs are believed to suffer from disadvantages including additional manufacturing steps and increased costs.

SUMMARY OF THE INVENTION

The present invention provides a fuel injector having a housing including an including an inlet, an outlet, and a passageway for fuel flow from the inlet to the outlet. A coil assembly is disposed proximate the inlet of the fuel injector. A seat is disposed proximate the outlet of the fuel injector. A closure member is disposed in the housing and operable by the coil assembly to permit and prohibit fuel flow through the seat. The closure member includes a strap member that extends along a longitudinal axis. The strap member has at least two radial projections and a central member. The strap member includes an outer surface a distance D from the longitudinal axis. The at least two radial projections having first and second ends. The closure member further includes a sealing member coupled to the central member and an armature member coupled to the second ends of the strap member.

The present invention further provides a method of forming a strap member that is disposed in an closure member of a fuel injector. The method can be achieved by stamping a planar component that has at least one central member and at least two radial projections disposed about a longitudinal axis and forming the at least two radial projections along the longitudinal axis.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention. In the Figures:

FIG. 2 shows a perspective view of the closure member.

FIG. 3 shows a plan view of the planar strap member.

FIG. 4 shows a perspective view of the formed strap member.

DETAILED DESCRIPTION OF THE PREFERRED EMBODIMENT(S)

Figure 1:
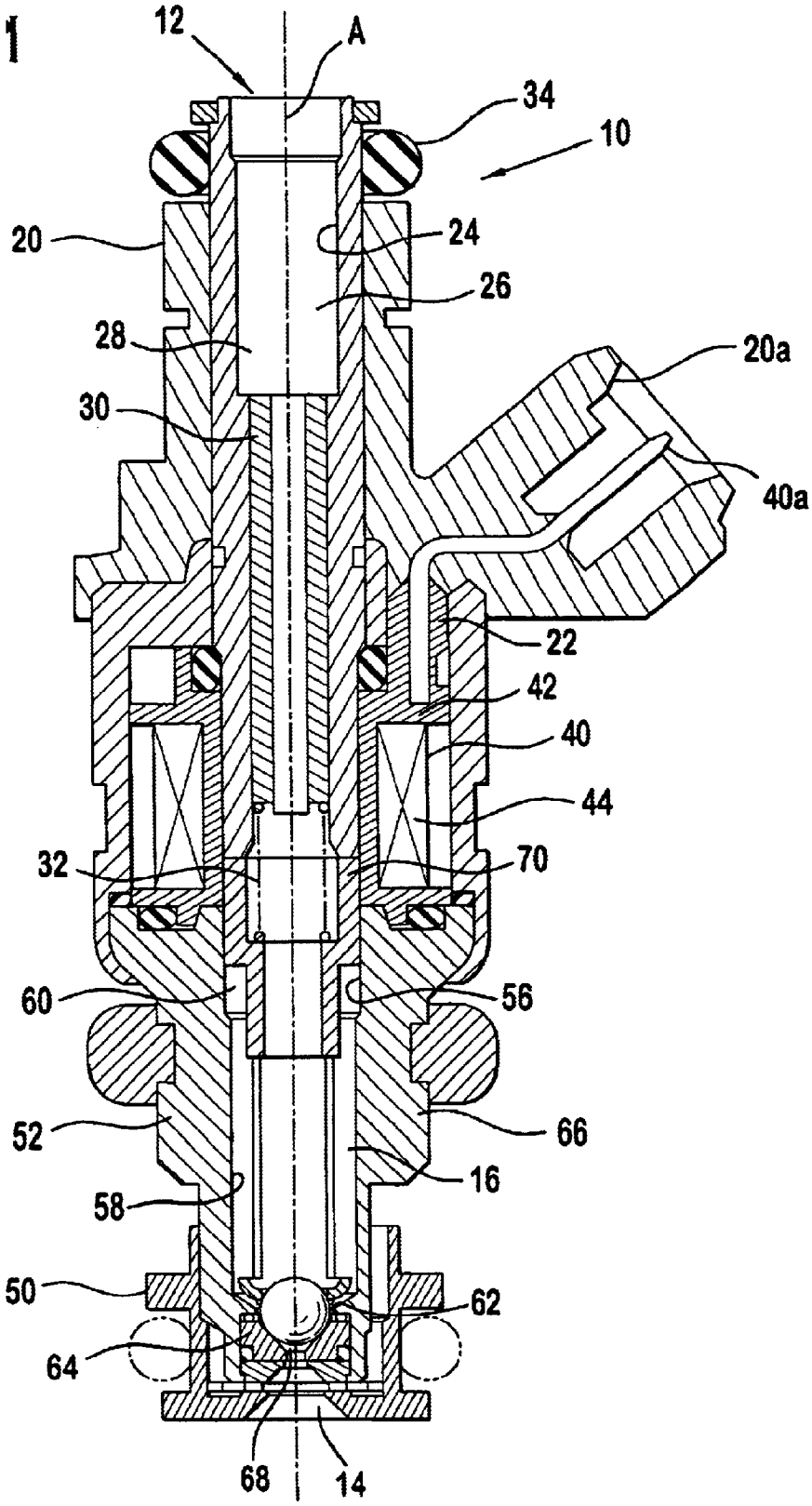
FIG. 1 shows a cross-sectional view of a fuel injector assembly including the closure member.

FIG. 1 shows an example of a fuel injector 10 including a closure member 70. The fuel injector assembly 10 has a housing, which includes a fuel inlet 12, a fuel outlet 14, and a fuel passageway 16 extending from the fuel inlet 12 to the fuel outlet 14 along a longitudinal axis A. The housing includes an overmolded plastic member 20 cincturing a metallic support member 22. A fuel inlet member 24 with an inlet passage 26 is disposed within the overmolded plastic member 20. The inlet passage 26 serves as part of the fuel passageway 16 of the fuel injector assembly 10. A fuel filter 28 and an adjustable tube 30 are provided in the inlet passage 26. The adjustable tube 30 is positionable along the longitudinal axis A before being secured in place, thereby varying the length of an armature bias spring 32. In combination with other factors, the length of the spring 32, and hence the bias force against the closure member 70, controls the quantity of fuel flow through the injector.

The overmolded plastic member 20 also supports a socket 20*a* that receives a plug (not shown) to operatively connect the fuel injector assembly 10 to an external source of electrical potential, such as an electronic control unit (not shown). An elastomeric O-ring 34 is provided in a groove on an exterior of the inlet member 24 to sealingly secure the inlet member 24 to a fuel supply member (not shown), such as a fuel rail.

The metallic support member 22 encloses an electromagnetic actuator assembly. An example of the actuator is a coil assembly 40. The coil assembly 40 includes a bobbin 42 that retains a coil 44. The ends of the coil assembly 40 are electrically connected to pins 40*a* mounted within the socket 20*a* of the overmolded plastic member 20. The closure member 70 is supported for relative movement along the longitudinal axis A with respect to the inlet member 24. The closure member 70 is supported by a body shell 50 and a body 52.

The body shell 50 engages the body 52. An armature guide eyelet 56 is located on an inlet portion 60 of the body 52. An axially extending body passage 58 connects the inlet portion 60 of the body 52 with an outlet portion 62 of the body 52. A seat 64, which is preferably a metallic material, is mounted at the outlet portion 62 of the body 52.

The body 52 includes a neck portion 66 that extends between the inlet portion 60 and the outlet portion 62. The neck portion 66 can be an annulus that surrounds a portion of the closure member 70.

Operative performance of the fuel injector assembly 10 is achieved by magnetically coupling the closure member 70 to the end of the inlet member 24 that is closest to the inlet portion 60 of the body 52. Thus, the lower portion of the inlet member 24 that is proximate to the closure member 70 serves as part of the magnetic circuit formed with the coil assembly 40. The closure member 70 is guided by the armature guide eyelet 56 and is responsive to an electromagnetic force generated by the coil assembly 40 for axially reciprocating the closure member 70 along the longitudinal axis A of the fuel injector assembly 10. The electromagnetic force is generated by current flow from the electronic control unit (not shown) through the coil assembly 40. Movement of the closure member 70 opens and closes a seat passage 68 of the seat 64, which permits or inhibits, respectively, fuel from flowing through the fuel outlet 14 of the fuel injector 10.

Fuel that is to be injected from the fuel injector 10 is communicated from the fuel inlet source (not shown), to the fuel inlet 12, through the fuel passageway 16, and exits from the fuel outlet 14. The fuel passageway 16 includes the inlet passage 26 of the inlet member 24, the body passage 58 of the body 52, and the seat passage 68 of the seat 64.

The closure member 70 will now be discussed in greater detail. The closure member 70 is disposed in the fuel injector housing and is operable by the coil assembly 40 to permit and prohibit fuel flow through the seat passage 68 of the seat 64. There is shown in FIG. 2 a perspective view of the closure member 70. The closure member 70 has a non-magnetic strap member 15, an armature member 37 and a sealing component 36.

There is shown in FIG. 3 a planar strap member 15. The planar strap member 15 has at least one central member 19 and at least two radial projections 17. The central member 19 and the at least two radial projections 17 are disposed about the longitudinal axis A. The central member 19 has a perimeter 32 and at least two connecting tabs 38. The perimeter 32 may provide a first perimeter 32*a*, a second perimeter 32*b*, a third perimeter 32*c* and a fourth perimeter 32*d*. The at least two connecting tabs 38 are engaged to the central member 19 via the first perimeter 32*a* and the second perimeter 32*b*. The at least two radial projections 17 are engaged to the central member 19 via the third perimeter 32*c* and fourth perimeter 32*d*. The at least two radial projections 17 are formed normal to the longitudinal axis A and circumferentially about the third perimeter 32*c* and fourth perimeter 32*d*. The at least two connecting tabs 38 are formed normal to the longitudinal axis A and circumferentially about the first perimeter 32*a* and second perimeter 32*b*. Forming the at least two radial projections 17 and the at least two connecting tabs 38 normal to the longitudinal axis A and circumferentially about their respective perimeters results in a tubularly formed strap member 31.

FIG. 4 shows the detail of the formed strap member 31. The at least one central member 19 preferably has a center hole 25. The center hole 25 is preferably pierced at the same time the planar strap member 15 is stamped. The sealing component 36 is coupled to the center hole 25 of the at least one central member 19. The sealing component 36 and the at least one central member 19 are coupled by a weld 25. It should be recognized by those skilled in the art that other methods for coupling the sealing component 36 and the at least one central member 19 are available. Examples of such other methods of assembly include puddle brazing, the use of adhesives and friction fitting so long as the sealing component 36 and the at least one central member 19 are secured together for relative movement. In a preferred embodiment, the sealing component 36 is a ball bearing. Those skilled in the art will recognize that other configurations and types of sealing components may be employed.

As shown in FIG. 2 the armature member 37 may be coupled by welds 21 to second ends 48 of the at least two radial projections 17. Openings 29 are provided between the at least two radial projections 17 after they have been formed. Automotive fuel is free to flow through the armature member 37 and out the openings 29 that are created when the at least two radial projections 17 are formed. The openings 29 along the length of the radial projections 17 provide an excellent area for full vapor purging during hot fuel handling operation. The geometries of the openings 29 are rectangular (non-circular) as well, which also improves the vapor handling, as vapor bubbles are typically spherical.

The strap member 15 is preferably made from a non-magnetic material. This allows for magnetic de-coupling between the armature member 37 and the sealing component 36. A length is associated with the distance between first ends 46 and the second ends 48 of the at least two radially formed projections 17 along the longitudinal axis A. The length may be varied in order to fabricate strap members 15 of different length. For example, if a closure member 70 with an extended tip is required for a particular fuel injector application, then the length of the strap member 15 may be increased. Thus, once assembled, the overall length of the closure member 70 is now increased.

There is an impact load on the strap member 15 of the closure member 70 that is generated by the reciprocation of the closure member 70 in the fuel injector 10. The impact load may act to deform the strap member 15 over the life of the fuel injector 10. In order to assure that there is virtually no deformation in the strap member 15 the following criteria must be observed. The cross sectional area of the strap member 15 in square inches, multiplied by the material yield strength of the strap member 15 in PSI, must be sufficient such that the strap member 15 will not plastically deform and possibly shorten, due to the repeated impacts generated by the load. If the closure member 70 were to shorten, it could change the performance of the fuel injector 10.

A method of forming a strap member disposed in a closure member of a fuel injector will now be described. The method may be achieved by stamping the planar strap member 15 having the at least one central member 19 and at least two radial projections 17 disposed about a longitudinal axis A. The at least two radial projections 17 are then formed normal to the longitudinal axis A. In the embodiment shown in FIG. 3, the planar strap member 15 is stamped and then formed as a second operation. Those skilled in the art will recognize that other low cost, accurate, and repeatable processes for creating the planar strap member 15 are available. They include drawn and EDM processes.

In an alternate embodiment, the planar strap member 15 may be stamped such that when formed, the strap member 31 is shaped like a rectangular box. In this embodiment, the at least one central member 19 may provide two central members 19 and the at least two radial projections may provide four radial projections 17. The sealing component 36 is coupled to the first one of the at least two central members 19 and the armature member 37 is coupled to the second one of the at least two central members 19. The four radial projections 17 are formed perpendicular to the longitudinal axis A.

In other embodiments, the planar strap member 15 may be stamped such that multiple combinations of radial projections 17 may be formed. For example, a strap member 31 with three radial projections 17 may be formed. In another example, a strap member 31 with six radial projections 17 may be formed.

While the present invention has been disclosed with reference to certain preferred embodiments, numerous modifications, alterations, and changes to the described embodiments are possible without departing from the spirit and scope of the present invention, as defined in the appended claims. Accordingly, it is intended that the present invention not be limited to the described embodiments, but that it have the full scope defined by the language of the following claims, and equivalents thereof.

What is claimed is:

1. A fuel injector having a housing including an inlet, an outlet, and a passageway for fuel flow from the inlet to the outlet, the fuel injector comprising:

a coil assembly disposed proximate the inlet of the fuel injector;

a seat disposed proximate the outlet of the fuel injector; and a closure member disposed in the housing and operable by the coil assembly to permit and prohibit fuel flow through the seat, the closure member including;

a unitary strap member extending along a longitudinal axis and having at least two projections and a central member defining an annulus having a concave surface facing the inlet about the longitudinal axis, the at least two projections having a first end extending from the concave surface of the annulus toward a second ends along the longitudinal axis, the at least two projections defining a first perimeter at the largest cross-sectional area of the projections about the longitudinal axis, the at least two projections being spaced apart about the longitudinal axis by openings extending along the length of each of the projections between the first end and second end;

a sealing member coupled to the central member, the sealing member having a portion surrounded by the concave surface of the annulus, the sealing member defining a second outermost perimeter at the largest cross-sectional area about the longitudinal axis being less than the first perimeter; and an armature member coupled to the second ends of the strap member.

2. The fuel injector according to claim 1, wherein each of the strap member and the armature member includes at least one flow hole therethrough, the at least one flow holes defining a fuel passage from the inlet to the outlet of the fuel injector.

3. The fuel injector according to claim 2 further comprising at least one flow holes disposed between the at least two projections of the strap member.

4. The fuel injector according to claim 1 wherein the at least one central member comprises a center hole formed on the central member and located generally about the longitudinal axis.

5. The fuel injector according to claim 1, wherein the sealing member comprises a spherical shaped member to engage the seat.

6. The fuel injector according to claim 5, wherein the spherical shaped member comprises a ball.

7. The fuel injector according to claim 1 wherein the strap member is fabricated out of a non-magnetic material.

8. The fuel injector according to claim 1 wherein a length is associated with the distance between the first end and the second end along the longitudinal axis.

9. The fuel injector according to claim 8 wherein the length may be varied.

10. The fuel injector according to claim 1 wherein the central member further comprises a perimeter and at least two connecting tabs.

11. The fuel injector according to claim 10 wherein the perimeter comprises a first, second, third and fourth perimeters.

12. The fuel injector according to claim 11 wherein the at least two connecting tabs are engaged to the first and second perimeters.

13. The fuel injector according to claim 12 wherein the at least two projections are engaged to the third and fourth perimeters.

14. The fuel injector according to claim 13 wherein the at least two projections are formed normal to the longitudinal axis and about at least two perimeters disposed on a common axis of the first, second, third and fourth perimeters.

15. The fuel injector of claim 1, wherein the central member comprises a convex surface facing the outlet, the concave and convex surfaces disposed orthogonally about the longitudinal axis.

16. The fuel injector of claim 15, wherein the sealing member includes a portion fixed to the convex surface by a weld between the annulus and the portion of the sealing member.

* * * * *